US005986606A

United States Patent [19]

Kossiavas et al.

[11] Patent Number: 5,986,606

[45] Date of Patent: Nov. 16, 1999

[54] PLANAR PRINTED-CIRCUIT ANTENNA WITH SHORT-CIRCUITED SUPERIMPOSED ELEMENTS

[75] Inventors: Georges Kossiavas; Albert Papiernik; Patrice Brachat; Josiane Cazajous; Philippe Ratajczak, all of Nice, France

[73] Assignee: France Telecom, Paris, France

[21] Appl. No.: 08/911,776

[22] Filed: Aug. 15, 1997

[30] Foreign Application Priority Data

Aug. 21, 1996 [FR] France ..... 96 10459

[51] Int. Cl.[6] ..... H01Q 1/38; H01Q 1/24

[52] U.S. Cl. ..... 343/700 MS; 343/846

[58] Field of Search ..... 343/700 MS, 846, 343/848, 702, 767, 713; H01Q 1/24, 1/38

[56] References Cited

U.S. PATENT DOCUMENTS

| | | | |
|---|---|---|---|
| 4,162,499 | 7/1979 | Jones, Jr. et al. | 343/700 MS |
| 5,621,571 | 4/1997 | Bantli et al. | 343/700 MS |
| 5,680,144 | 10/1997 | Sanad | 343/700 MS |
| 5,703,601 | 12/1997 | Nalbandian et al. | 343/700 MS |

FOREIGN PATENT DOCUMENTS

| | | |
|---|---|---|
| 2 552 938 | 4/1985 | France . |
| 195 12 003 A1 | 10/1995 | France . |
| 60-058704 | 4/1985 | Japan . |
| 61-041205 | 2/1986 | Japan . |

*Primary Examiner*—Hoanganh Le
*Attorney, Agent, or Firm*—Kinney & Lange, P.A.

[57] ABSTRACT

A planar printed-circuited antenna for the transmission and/or reception of microwave signals has a first conductive element or patch substantially parallel to a ground plane, a first dielectric substrate separating the first patch from the ground plane, supply structure for the antenna, and at least one second patch which substantially identical to the first patch. The second patch is superimposed on the first patch and is substantially parallel to the ground plane. A second dielectric substrate separates the first and second patches, and at least one first short-circuit connects the first and second patches to each other. According to the invention, at least one of the first and second patches includes at least one slot.

4 Claims, 3 Drawing Sheets

FIG. 6a
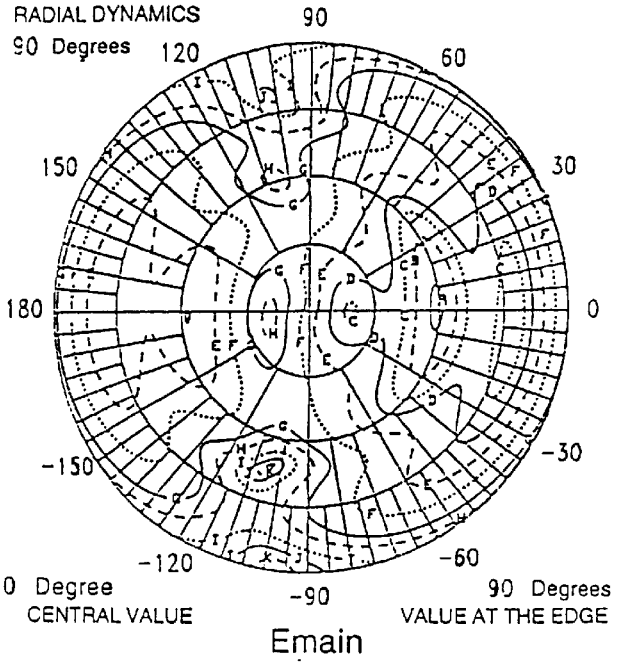
FIG. 6b
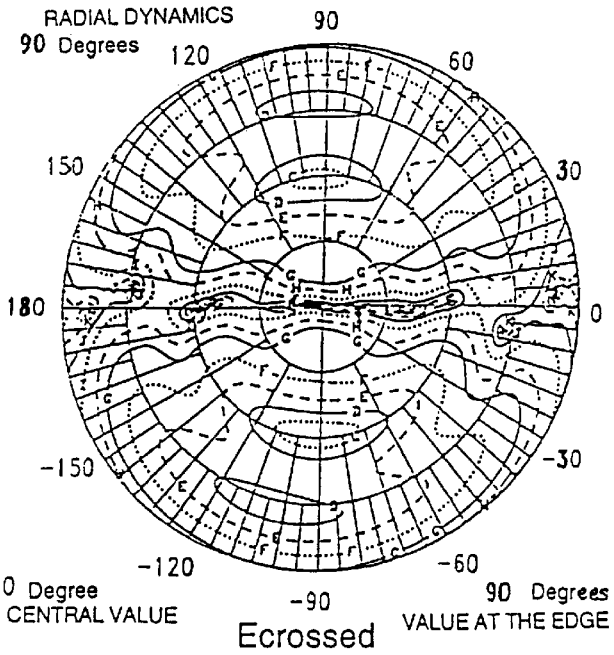
FIG. 6c
| | |
|---|---|
| NORM : | -6.36 dB |
| ——A—— | -0.0999999 dB |
| ----B---- | -1 dB |
| ·····C····· | -2 dB |
| ——D—— | -3 dB |
| ----E---- | -5 dB |
| ·····F····· | -8 dB |
| ——G—— | -12 dB |
| ----H---- | -15 dB |
| ·····I····· | -20 dB |
| ——J—— | -25 dB |
| ----K---- | -30 dB |
| ·····L····· | -35 dB |
| ——M—— | -40 dB |
| ----N---- | -45 dB |
| ·····O····· | -50 dB |

PLANAR PRINTED-CIRCUIT ANTENNA WITH SHORT-CIRCUITED SUPERIMPOSED ELEMENTS

BACKGROUND OF THE INVENTION

1. Field of the Invention

The field of the invention is that of small-sized electromagnetic antennas which, depending on their geometry, are capable of working at frequencies of some hundreds of MHz to some GHz.

More specifically, the invention relates to a small-sized plane printed-circuit antenna.

Small-sized antennas have numerous applications such as, for example, communications with mobile units (the antennas are, in this case, placed in portable radiomobile terminals working together with terrestrial or satellite-based communications networks), close-range communications (between computers or inside a building for example), for identification devices etc.

2. Description of the Prior Art

In the prior art, there are two main types of known small-sized antennas, namely:

wire antennas, of the dipole type or derived therefrom, generally working at frequencies of below 1 GHz.

planar (or printed-circuit) antennas, working at frequencies of above 0.5 GHz. They are constituted by a metal patch parallel to a ground plane. The patch is also called a "patch".

Known examples of small-sized planar antennas include the quarter-wave antenna, the PIFA or "Planar Inverted F Antenna", the monolayer C type antenna and the H antenna.

There are two main existing drawbacks in most of the antennas proposed in the prior art: these are excessively great dimensions and an excessively small passband. In other words, the amount of space required by known antennas is as yet far too great and their passband is far too small for terminals that are becoming increasingly compact.

SUMMARY OF THE INVENTION

The invention is aimed especially at overcoming these different drawbacks of the prior art.

More specifically, one of the aims of the present invention is to provide a very compact planar printed-circuit antenna, namely an antenna that is very small-sized in relation to the operating wavelength.

The invention is also aimed at providing a small-sized antenna of this kind having a wide passband.

Another aim of the invention is to provide a small-sized two-band antenna.

These different aims, as well as others that shall appear hereinafter, are achieved according to the invention by means of a planar printed-circuit antenna for the transmission and/or reception of microwave signals of the type comprising, in particular:

a first conductive element or patch substantially parallel to a ground plane, a first dielectric substrate separating said first patch from said ground plane, supply means for said antenna, at least one second patch that is substantially identical to said first patch, said second patch being superimposed on said first patch and being substantially parallel to said ground plane, a second dielectric substrate separating said first and second patches, at least one first short-circuit connects said first and second patches to each other, wherein at least one of said first and second patches comprises at least one slot.

The general principal of the invention therefore consists in introducing a short-circuit between two superimposed patches, at least one one of which comprising one (or more) slot(s).

In other words, the invention relates to the introduction of slots into the geometry of the patches. Indeed, the presence of appropriately placed slots (or apertures) is liable to lengthen the electrical current lines and thus enable:

either operation at lower frequency for an antenna with given space requirement, or a reduction of the size of the antenna for operation at a given frequency.

The reduction of the dimensions of the antenna also results from the presence of planes of partial short-circuits between superimposed patches (or between patches and ground) which also lengthens the current lines.

Besides, the widening of the passband is obtained by the superimposition of metallic elements.

The present invention allows to obtain different structures of very small-sized antennas (typically 35 mm×35 mm) capable of working in the region of 2 GHz. It is clear that, with even smaller dimensions, they may work at higher frequencies.

Advantageously, at least one second short-circuit connects said first patch with said ground plane.

Preferably, said first dielectric substrate and/or said second dielectric substrate belong to the group comprising air and the other dielectric materials.

In an advantageous embodiment of the invention, each of said first and second patches possesses a C shape and comprises a slot defining a first free end and a second free end, and the first free ends of the first and second patches are connected by said first short circuit.

This advantageous embodiment of the invention is known as the short-circuited multilayer C type antenna. The term "multilayer" indicates the presence of two superimposed patches.

Advantageously, in the case of this advantageous embodiment of the invention, each of said first and second patches possesses a shape identical to that of a patch of a monolayer C type antenna.

Indeed, in the prior art, there is a known monolayer C type antenna (an antenna that therefore has only one patch). This antenna was obtained from a folded dipole. This was done by cutting it along its axis of symmetry and by keeping only half of it, after observing that the current was very low in the metal strip connecting the two parts of the antenna.

The short-circuited multilayer C type antenna of the invention, for its part, is obtained by "folding" the dipole around its plane of symmetry. In other words, the invention runs completely counter to the technique used here above since both the half antennas thus obtained are kept and not just one of them. According to the invention, these two half antennas, which are identical and superimposed, constitute the two patches. The metal strip that connects them is the first short-circuit between the two patches.

The short-circuited multilayer C type antenna appears to use the first mode (usually the non-radiating mode) of the folded dipole. Assuming that the current distribution of the first mode of the folded dipole is maintained, the two half antennas obtained, kept superimposed, have similar patterns of current distribution and their values of radiation are added together. Thus, the radiation is created while at the same time reducing the surface area of the antenna by a ratio of 2.

Advantageously, each of said first and second patches, with an exception being made for said slot, has an essentially square shape, with a side length $1=\lambda/12$ approximately, with $\lambda$ as the wavelength of operation of the antenna.

Thus, a planar antenna with exceptionally small lateral dimensions is obtained. Indeed, as far as the present Applicants are aware, there is no existing antenna with dimensions as small as these. It will be recalled, in particular, that the conventional antenna is generally square-shaped, with a side length $1=\lambda/2$.

BRIEF DESCRIPTION OF THE DRAWINGS

Other features and advantages of the invention shall appear from the following description of a preferred embodiment of the invention, given by way of a non-restrictive exemplary indication and from the appended drawings, of which:

FIGS. 6(*a*) and 6(*b*) each show a radiation pattern of an exemplary short-circuited multilayer C type antenna such as the one shown in FIGS. 2, 3 and 4, for main polarization (FIG. 6(*a*)) and crossed polarization (FIG. 6(*b*)) respectively;

FIG. 6(*c*) shows a table of correspondence of the references of the contour lines of FIGS. 6(*a*) and 6(*b*).

MORE DETAILED DESCRIPTION

The invention therefore relates to a small-sized planar antenna comprising, in particular, two conductive elements or patches that are superimposed (so as to be parallel to the ground plane) and short-circuited with respect to each other. The lower patch and the ground plane may also be short-circuited. The two patches may have one or more slots.

Hereinafter in the description, a particular embodiment of the antenna of the invention is presented. It is called "short-circuited multilayer C type antenna".

Figure 2:
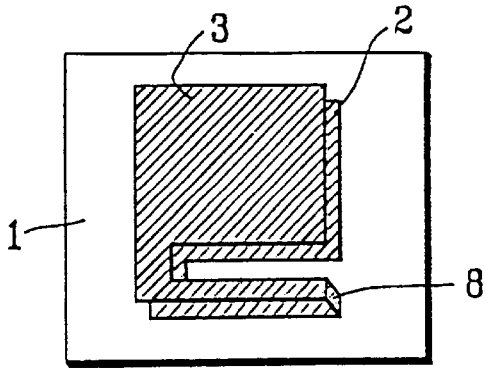
FIGS. 2, 3 and 4 each present a view in perspective, a side view and a top view respectively of a particular embodiment of the antenna according to the invention, called a short-circuited multilayer C type antenna.
Figure 3:
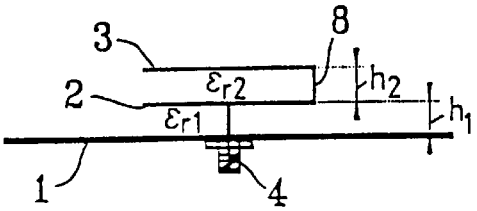
Figure 4:
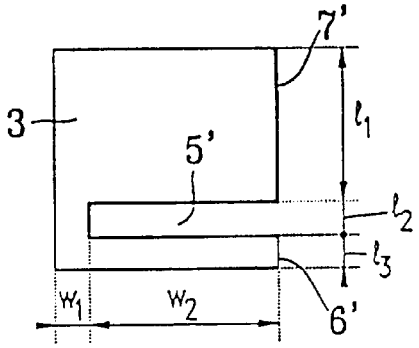

A description is now provided, with reference to FIGS. 2, 3 and 4, of this particular embodiment of the antenna of the invention, namely the short-circuited multilayer C type antenna. FIGS. 2, 3 and 4 each present a view in perspective, a side view and a top view respectively of this short-circuited multilayer C type antenna according to the invention.

This antenna comprises a ground plane 1 and two superimposed patches 2, 3 (called the lower patch 2 and the upper patch 3). It also includes a coaxial supply 4.

The lower patch 2 and the upper patch 3 are identical. Each has a "C" shape, a slot 5, 5' made in an initially square shape defining a first free end 6, 6' and a second free end 7, 7'. The first free ends 6, 6' of the two patches 2, 3 are connected by a short-circuit 8.

Figure 3B:
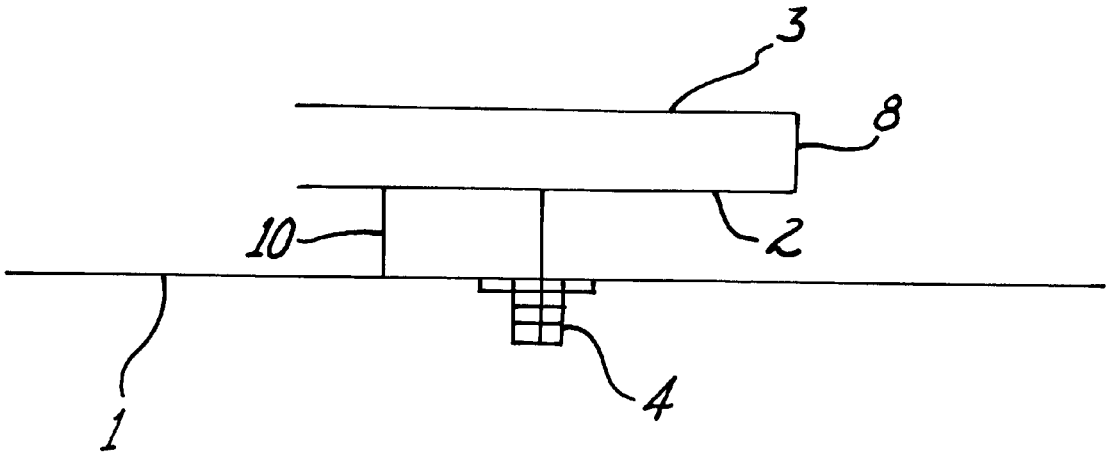
FIG. 3*b* presents a side view of an alternative embodiment of the invention.

FIG. 3*b* shows an alternative embodiment of the invention, similar to FIG. 3, but further including a second short circuit 10 which connects the lower patch 2 with the ground plane 1.

Figure 1:
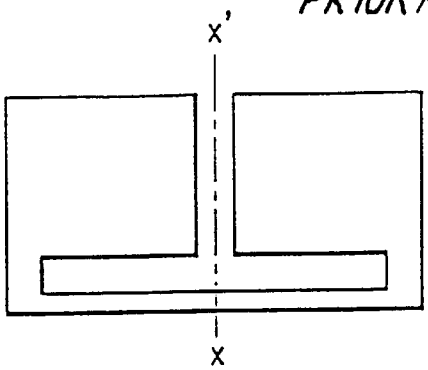
FIG. 1 PRIOR ART
FIG. 1 shows a top view of a known folded dipole of the prior art.

FIG. 1 shows a top view of a folded dipole known in the prior art. The short-circuited multilayer C type antenna of the invention is obtained by "folding" this folded dipole about its axis of symmetry xx'. It is the two half antennas obtained, which are identical and superimposed, that constitute the lower patch 2 and upper patch 3. The metal strip that joins them constitutes the short circuit 8 between the two patches 2, 3.

The short-circuited multilayer C type antenna appears to use the first mode (usually the non-radiating mode) of the folded dipole. If it is assumed that the current distribution of the first embodiment of the first dipole is maintained, then the two half antennas obtained, which are now superimposed, have similar patterns of current distribution and their values of radiation are added together. Thus, the radiation is created while, at the same time, the surface area of the antenna is reduced in a ratio of 2.

The results obtained with two exemplary short-circuited multilayer C type antennas according to the invention are presented here below. Table I here below presents the precise dimensions of these two exemplary antennas.

In these two examples, if an exception is made for the presence of the slot 5, 5', the two patches 2, 3 are square shaped ($l_1+l_2+l_3=w_1+w_2$).

In the first example, (the first line of the table I), the antenna is entirely metallic. The space located between the ground plane 1 and the lower patch 2, and the space located between the lower patch 2 and the upper patch 3 are both filled with air ($\epsilon_{r1}=\epsilon_{r2}=1$). The antenna has a thickness of 6 mm ($h_1+h_2$), and a total space requirement of 20×20×6 mm.

In the second example (the second line of the table I), the space located between the ground plane 1 and the lower patch 2 is filled with air ($\epsilon_{r1}=1$), while the space located between the lower patch 2 and the upper patch 3 is filled with substrate ($\epsilon_{r2}=2.2$). The antenna has a thickness of 3 mm ($h_1+h_2$), and a total space requirement of 13.5×13.5×6 mm.

The following have been entered in Table I:

$h_1$ the spacing between the ground plane 1 and the lower patch 2;

$h_2$ the spacing between the lower patch 2 and upper patch 3;

$\epsilon_{r1}$ the relative permittivity of the dielectric element located between the ground plane 1 and the lower patch 2;

$\epsilon_{r2}$ the relative permittivity of the dielectric element located between the lower patch 2 and upper patch 3;

l1 the width of each second free end 7, 7';

l2 the width of each slot 5, 5';

l3 the width of each first free end 6, 6';

w1 the width of the zone connecting the first free ends 6, 6' and second free ends 7, 7';

w2 the length of each slot 5, 5'.

TABLE I

| Type of antenna | $h_1$ (mm) | $h_2$ (mm) | $\epsilon_{r1}$ | $\epsilon_{r2}$ | $l_1$ (mm) | $l_2$ (mm) | $l_3$ (mm) | $w_1$ (mm) | $w_2$ (mm) |
|---|---|---|---|---|---|---|---|---|---|
| without substrate | 3 | 3 | 1 | 1 | 12 | 4 | 4 | 4 | 16 |
| with substrate | 1.5 | 1.5 | 1 | 2.2 | 7 | 3.5 | 3 | 3.5 | 10 |

With the antenna of the first example (which is entirely metallic), a resonance at a frequency of 1.2 GHz is obtained. By comparison, a standard square-shaped element at the same frequency would have dimensions six times greater. The passband obtained is 2.5% for an S.W.R. of less than 2.

FIGS. 6(*a*) and 6(*b*) each show a radiation pattern of this first exemplary short-circuited multilayer C type antenna, for the main polarization (FIG. 6(*a*)) and the crossed polarization (FIG. 6(*b*)) respectively. FIG. 6(*c*) shows a table of correspondence of the references of the contour lines of FIGS. 6(*a*) and 6(*b*).

These radiation patterns bring out the relatively omnidirectional character of the radiation, which is due to the small size of the patches. They also bring out the absence of purity of polarization, which is due to the complex geometry of these patches.

The antenna of the second example (comprising substrate) has a resonance at a frequency of 1.47 GHz, with a passband of 0.3% at an S.W.R. equal to 2. The dimensions of the patches have therefore been further reduced, at the cost of a reduction of the passband by the use of a dielectric substrate which, in this example is a Duroid (registered mark) type of substrate with $\epsilon_{r2}$=2.2) between the two superimposed patches.

Figure 5:
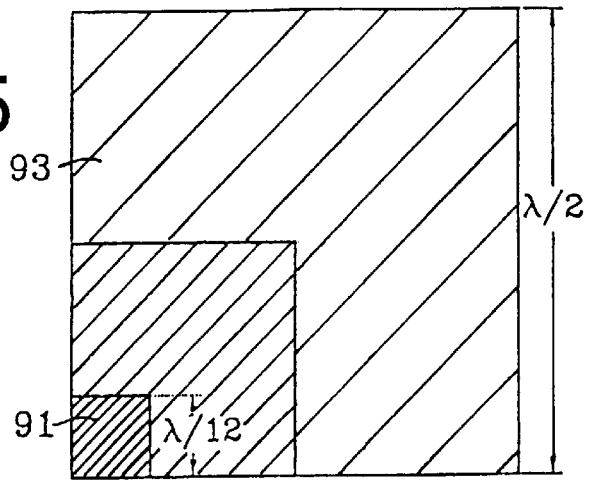
FIG. 5 enables the dimensions of the antennas according to the particular embodiment of the invention to be compared with those of conventional antennas.

FIG. 5 enables the dimensions of the antennas according to the different embodiments of the invention to be compared with those of the standard antennas.

The square 91 with a side $\lambda/12$, with $\lambda$ as the operating wavelength of the antenna, corresponds to the dimensions of the superimposed and short-circuited patches of the multilayer C type antenna of the invention. As far as the present Applicants are aware, this multilayer C type antenna is the smallest that has been made. Its small passband (2.5%) could be increased by the optimization of its geometry. The square 93 with a side $\lambda/2$ recalls the dimensions of the single patch used in standard antennas.

It is clear that the present invention can be implemented with different types of slots and short-circuits.

In general, to implement the present invention, the position and shape of the slot(s) or of the partial short-circuit(s) can be determined by:

the analysis (by computation or reasoning based on the principles of physics) of the distribution of the current before the introduction of the slots or short-circuit planes, to plan for the location of these short-circuit planes.

the study (by computation or reasoning based on the principles of physics) of the distribution of the current before the introduction of the slots or short-circuit planes, to foresee the repercussions on the radiation pattern, the input impedance and the output of the antenna.

What is claimed is:

1. A planar printed-circuit antenna for the transmission and/or reception of microwave signals, comprising:

a first conductive element or patch substantially parallel to a ground plane, the first patch being a C-patch, such that the first patch corresponds to one half of a folded dipole which would have been cut along an axis of symmetry of the folded dipole, said first patch having an essentially rectangular shape with a first side essentially parallel to said axis of symmetry of the folded dipole, said first patch being provided with a slot with first and second edges defined on opposing sides of the slot, the second edge connecting halves of the folded dipole, a first dielectric substrate separating said first patch from said ground plane, supply means for said antenna, at least one second patch, said second patch being superimposed on said first patch and being substantially parallel to said ground plane, the second patch corresponding to the other half of the folded dipole, a second dielectric substrate separating said first and second patches, at least one first short-circuit connecting the second edge of said first patch with the second edge of said second patch.

2. An antenna according to claim 1, wherein at least one second short-circuit connects said first patch with said ground plane.

3. An antenna according to claim 1, wherein said first dielectric substrate and/or said second dielectric substrate belong to the group comprising air and the other dielectric materials.

4. An antenna according to claim 1, wherein each of said first and second patches has an essentially square outline with a side length $1=\lambda/12$ approximately, with $\lambda$ as the wavelength of operation of the antenna, with the slot being within the square outline.

* * * * *